US010837625B2

(12) United States Patent
Bowen

(10) Patent No.: US 10,837,625 B2
(45) **Date of Patent: *Nov. 17, 2020**

(54) REPLACEABLE BAFFLES FOR LIGHT FIXTURES

(71) Applicant: SIGNIFY HOLDING B.V., Eindhoven (NL)

(72) Inventor: John Bowen, Sharpsburg, GA (US)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

This patent is subject to a terminal disclaimer.

(21) Appl. No.: 16/708,118

(22) Filed: Dec. 9, 2019

(65) Prior Publication Data

US 2020/0116334 A1 Apr. 16, 2020

Related U.S. Application Data

(63) Continuation of application No. 15/987,362, filed on May 23, 2018, now Pat. No. 10,502,397.

(51) Int. Cl.

| | |
|---|---|
| ***F21V 17/00*** | (2006.01) |
| ***F21S 8/02*** | (2006.01) |
| ***F21V 1/12*** | (2006.01) |
| ***F21V 17/12*** | (2006.01) |

(52) U.S. Cl.

CPC ..... *F21V 17/002* (2013.01); *F21S 8/026* (2013.01); *F21V 1/12* (2013.01); *F21V 17/005* (2013.01); *F21V 17/12* (2013.01)

(58) Field of Classification Search

CPC ..... F21V 17/002; F21V 1/12; F21V 17/005; F21V 17/12; F21S 8/026

USPC ..... 362/257

See application file for complete search history.

(56) References Cited

U.S. PATENT DOCUMENTS

| | | | | |
|---|---|---|---|---|
| 6,402,345 | B1 | 6/2002 | Fishman | |
| 10,502,397 | B1 * | 12/2019 | Bowen | F21V 17/12 |
| 2008/0205054 | A1 | 8/2008 | Ho | |

FOREIGN PATENT DOCUMENTS

| | | |
|---|---|---|
| GB | 2551058 | 12/2017 |

* cited by examiner

*Primary Examiner* — Cara E Rakowski
*Assistant Examiner* — Jessica M Apenteng
(74) *Attorney, Agent, or Firm* — Akarsh P. Belagodu

(57) ABSTRACT

A light fixture can include a housing having at least one housing wall having an inner surface that forms a cavity, where the inner surface of the at least one housing wall has at least one baffle coupling feature disposed thereon. The light fixture can also include a baffle removably coupled to the housing, where the baffle includes at least one baffle wall having an outer surface, where the outer surface of the at least one baffle wall has at least one housing coupling feature disposed thereon. The baffle can be coupled to the housing and decoupled from the housing without use of tools.

20 Claims, 7 Drawing Sheets

REPLACEABLE BAFFLES FOR LIGHT FIXTURES

CROSS REFERENCE TO RELATED APPLICATIONS

This application is a continuation application of and claims priority under 35 U.S.C. § 120 to U.S. patent application Ser. No. 15/987,362, titled "Replaceable Baffles For Light Fixtures" and filed on May 23, 2018, the entire contents of which are hereby incorporated by reference herein.

TECHNICAL FIELD

Embodiments described herein relate generally to light fixtures, and more particularly to systems, methods, and devices for baffles for light fixtures.

BACKGROUND

Baffles are used in light fixtures to soften the effects of light emitted by one or more light sources of a light fixture. Baffles are common in certain types of light fixtures, such as down can light fixtures (also known as recessed light fixtures and downlight fixtures). Baffles can have different features disposed on their inner surface to have the desired effect (e.g., reduced glare) on emitted light.

SUMMARY

In general, in one aspect, the disclosure relates to a light fixture that can include a housing having at least one housing wall having an inner surface that forms a cavity, where the inner surface of the at least one housing wall has at least one baffle coupling feature disposed thereon. The light fixture can also include a baffle removably coupled to the housing, where the baffle includes at least one baffle wall having an outer surface, where the outer surface of the at least one baffle wall has at least one housing coupling feature disposed thereon. The baffle can be coupled to the housing and decoupled from the housing without use of tools.

In another aspect, the disclosure can generally relate to a baffle for a light fixture that can include at least one wall having an inner baffle surface and an outer baffle surface, where the inner baffle surface is configured to control effects of light emitted by the light fixture. The baffle can also include at least one housing coupling feature disposed on the outer baffle surface of the at least one wall. The at least one housing coupling feature can be configured to detachably couple to at least one baffle coupling feature disposed on an inner housing surface of a housing of the light fixture. The at least one housing coupling feature can be configured to couple to the at least one baffle coupling feature and decouple from the at least one baffle coupling feature without use of tools.

In yet another aspect, the disclosure can generally relate to a housing for a light fixture that can include at least one wall having an inner surface, where the inner surface is configured to receive at least a portion of a baffle of the light fixture, where the inner surface of the at least one wall has disposed thereon at least one baffle coupling feature. The at least one baffle coupling feature can be configured to detachably couple to at least one housing coupling feature disposed on an outer surface of the baffle of the light fixture. The at least one baffle coupling feature can be configured to couple to the at least one housing coupling feature and decouple from the at least one housing coupling feature without use of tools.

These and other aspects, objects, features, and embodiments will be apparent from the following description and the appended claims.

BRIEF DESCRIPTION OF THE DRAWINGS

The drawings illustrate only example embodiments of replaceable baffles for light fixtures and are therefore not to be considered limiting of its scope, as replaceable baffles for light fixtures may admit to other equally effective embodiments. The elements and features shown in the drawings are not necessarily to scale, emphasis instead being placed upon clearly illustrating the principles of the example embodiments. Additionally, certain dimensions or positions may be exaggerated to help visually convey such principles. In the drawings, reference numerals designate like or corresponding, but not necessarily identical, elements.

DETAILED DESCRIPTION OF EXAMPLE EMBODIMENTS

Figure 1:
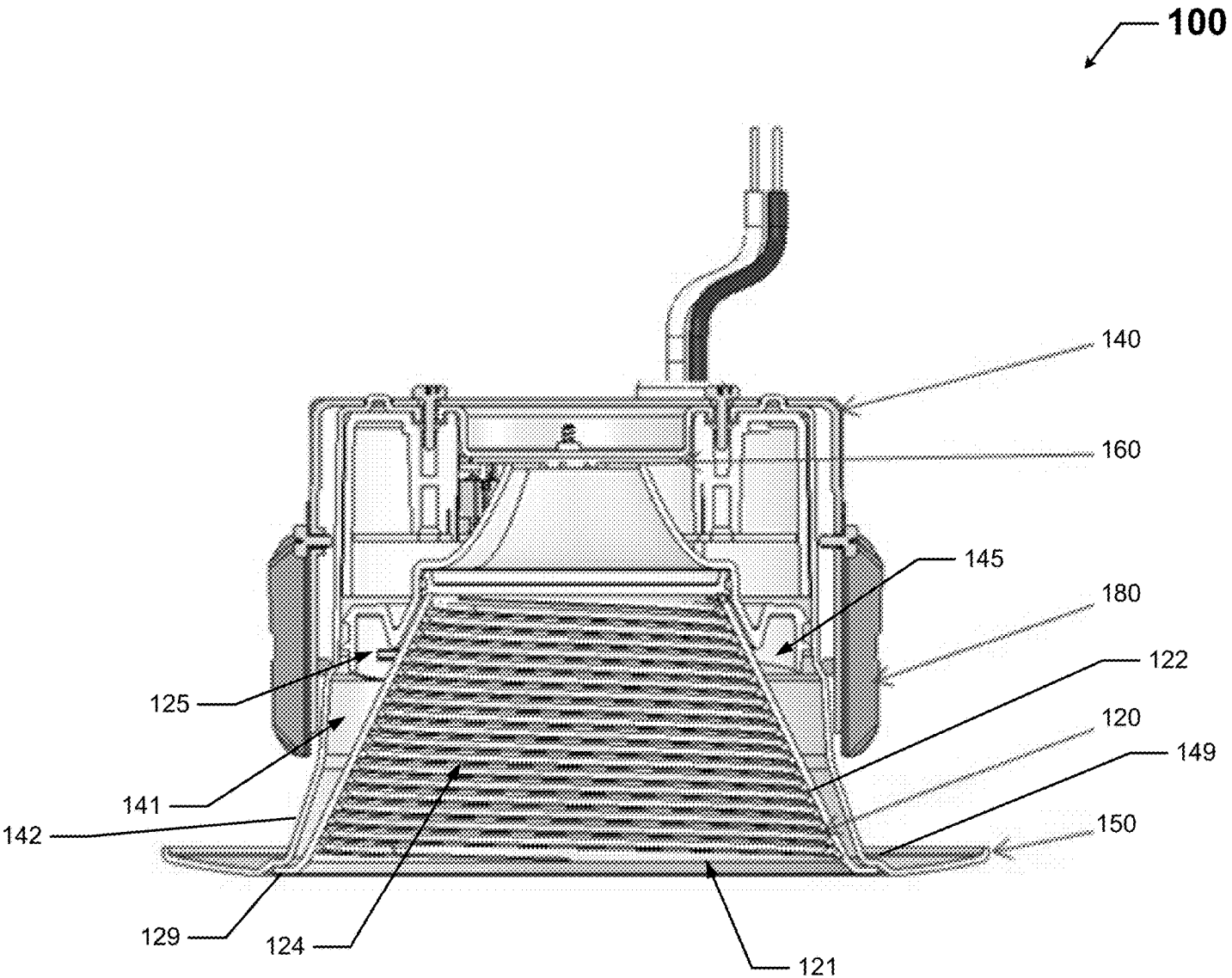
FIG. 1 shows a cross-sectional side view of a light fixture in accordance with certain example embodiments.

The example embodiments discussed herein are directed to systems, methods, and devices for replaceable baffles for light fixtures. While example embodiments are described herein as being used with downlight can light fixtures, example embodiments can also be used with other types of light fixtures that include a baffle. The light fixtures described herein can use one or more of a number of different types of light sources, including but not limited to light-emitting diode (LED) light sources, fluorescent light sources, organic LED light sources, incandescent light sources, and halogen light sources. Therefore, light fixtures described herein should not be considered limited to a particular type of light source.

The downlight can fixtures shown and described herein can be of any of a number of sizes (e.g., 4 inches, 6 inches). Similarly, other types of light fixtures that can be used with example embodiments can be any of a number of sizes. A user may be any person that interacts with a light fixture. Examples of a user may include, but are not limited to, an engineer, an electrician, an instrumentation and controls technician, a mechanic, an operator, a consultant, a contractor, a maintenance technician, a homeowner, a tenant, a building manager, a landlord, and a manufacturer's representative.

As discussed below, light fixtures described herein include multiple components. Each of these components can be made of one or more of any number of materials. Such materials can include, but are not limited to, metal (e.g., aluminum, steel), rubber, ceramic, plastic (e.g., nylon), thermoplastic, and glass. Some components can be a portion of another component of the light fixture, while other components can be independent of the remaining components of the light fixture.

In certain example embodiments, light fixtures with example replaceable baffles are subject to meeting certain standards and/or requirements. For example, the National Electric Code (NEC), the National Electrical Manufacturers Association (NEMA), the International Electrotechnical Commission (IEC), Underwriters Laboratories (UL), the Federal Communication Commission (FCC), the Bluetooth Special Interest Group, and the Institute of Electrical and Electronics Engineers (IEEE) set standards that can be applied to electrical enclosures (e.g., light fixtures), wiring, location services, and electrical connections. Use of example embodiments described herein meet (and/or allow a corresponding device to meet) such standards when required.

Any light fixtures, or components thereof (e.g., housings, example baffles), described herein can be made from a single piece (e.g., as from a mold, injection mold, die cast, 3-D printing process, extrusion process, stamping process, or other prototype methods). In addition, or in the alternative, a light fixture (or components thereof) can be made from multiple pieces that are mechanically coupled to each other. In such a case, the multiple pieces can be mechanically coupled to each other using one or more of a number of coupling methods, including but not limited to epoxy, welding, fastening devices, compression fittings, mating threads, tabs, and slotted fittings. One or more pieces that are mechanically coupled to each other can be coupled to each other in one or more of a number of ways, including but not limited to fixedly, hingedly, removeably, slidably, and threadably.

Components and/or features described herein can include elements that are described as coupling, fastening, securing, abutting, or other similar terms. Such terms are merely meant to distinguish various elements and/or features within a component or device and are not meant to limit the capability or function of that particular element and/or feature. For example, a feature described as a "coupling feature" can couple, secure, fasten, abut, and/or perform other functions aside from merely coupling.

A coupling feature (including a complementary coupling feature) as described herein can allow one or more components and/or portions of a light fixture to become coupled, directly or indirectly, to another portion of the light fixture and/or some other feature/component. A coupling feature can include, but is not limited to, a tab, a snap, a clamp, a portion of a hinge, an aperture, a recessed area, a protrusion, a slot, a spring clip, a tab, a detent, and mating threads. One portion of a light fixture can be coupled to another component of the light fixture by the direct use of one or more coupling features.

In addition, or in the alternative, a portion of a light fixture can be coupled to another component of the light fixture using one or more independent devices that interact with one or more coupling features disposed on a component (e.g., a baffle, a housing) of the light fixture. Examples of such devices can include, but are not limited to, a pin, a hinge, a fastening device (e.g., a bolt, a screw, a rivet), epoxy, glue, adhesive, tape, and a spring. One coupling feature described herein can be the same as, or different than, one or more other coupling features described herein. A complementary coupling feature (also sometimes called a corresponding coupling feature) as described herein can be a coupling feature that mechanically couples, directly or indirectly, with another coupling feature.

If a component of a figure is described but not expressly shown or labeled in that figure, the label used for a corresponding component in another figure can be inferred to that component. Conversely, if a component in a figure is labeled but not described, the description for such component can be substantially the same as the description for the corresponding component in another figure. The numbering scheme for the various components in the figures herein is such that each component is a three digit number and corresponding components in other figures have the identical last two digits. For any figure shown and described herein, one or more of the components may be omitted, added, repeated, and/or substituted. Accordingly, embodiments shown in a particular figure should not be considered limited to the specific arrangements of components shown in such figure.

Further, a statement that a particular embodiment (e.g., as shown in a figure herein) does not have a particular feature or component does not mean, unless expressly stated, that such embodiment is not capable of having such feature or component. For example, for purposes of present or future claims herein, a feature or component that is described as not being included in an example embodiment shown in one or more particular drawings is capable of being included in one or more claims that correspond to such one or more particular drawings herein.

Example embodiments of replaceable baffles for light fixtures will be described more fully hereinafter with reference to the accompanying drawings, in which example embodiments of replaceable baffles for light fixtures are shown. Replaceable baffles for light fixtures may, however, be embodied in many different forms and should not be construed as limited to the example embodiments set forth herein. Rather, these example embodiments are provided so that this disclosure will be thorough and complete, and will fully convey the scope of replaceable baffles for light fixtures to those of ordinary skill in the art. Like, but not necessarily the same, elements (also sometimes called components) in the various figures are denoted by like reference numerals for consistency.

Terms such as "first", "second", "outer", "inner", "distal", "proximal", "top", "bottom", "on", and "within" are used merely to distinguish one component (or part of a component or state of a component) from another. Such terms are not meant to denote a preference or a particular orientation, and are not meant to limit embodiments of replaceable baffles for light fixtures. In the following detailed description of the example embodiments, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

Figure 2:
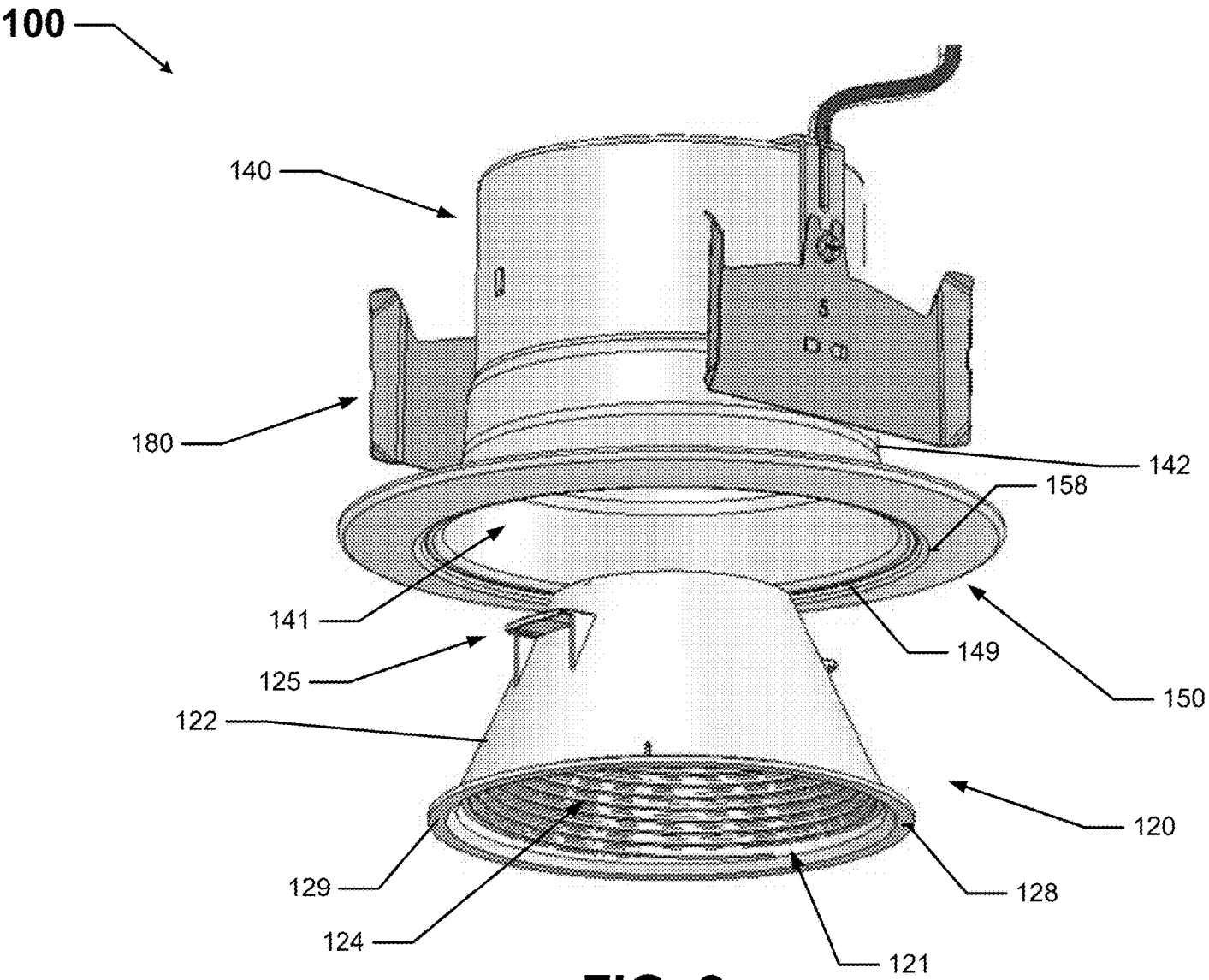
FIG. 2 shows an exploded bottom-front-side perspective view of the light fixture of FIG. 1.

FIG. 1 shows a cross-sectional side view of a light fixture 100 in accordance with certain example embodiments. FIG. 2 shows an exploded bottom-front-side perspective view of the light fixture 100 of FIG. 1. Referring to FIGS. 1 and 2, the light fixture 100 can include one or more of a number of components. For example, as shown in FIG. 1, the light fixture 100 in this case includes a housing 140, a baffle 120, a trim 150, at least one light source 160, and one or more mounting features 180. A light fixture can also include one or more other components (e.g., a power source, a lens) that are not shown or described herein.

Each mounting feature 180 can be used to mount the light fixture 100 to a structure and/or feature. Examples of a structure and/or feature can include, but are not limited to, a ceiling, a wall, a rafter, an I-beam, a girder, a pole, a stud, plywood, and drywall. A mounting feature 180 can include one or more of a number of features and/or components, including but not limited to, a bracket, a spring clip, a torsion spring, a protrusion, a recess, a fastening device (e.g., a screw, a bolt, a rivet), and a detent.

In this case, there are two identical mounting features 180 that are disposed on the outer surface of a wall 142 of the housing 140 equidistantly with respect to each other. The mounting features 180 in this case are friction blades. A mounting feature 180 can be integrated with a component (e.g., the housing 140) of the light fixture 100. Alternatively, a mounting feature 180 can be permanently coupled to or removably coupled to a component of the light fixture 100. For example, in this case, both mounting features 180 are removably coupled to a wall 142 of the housing 140 of the light fixture 100.

The one or more light sources 160 of the light fixture 100 are used to emit light. A light source 160 can be one or more of a number of different types of light sources, including but not limited to light-emitting diode (LED) light sources, organic LEDs, fluorescent light sources, organic LED light sources, incandescent light sources, and halogen light sources. When the light sources are LEDs, those LED light sources can include any type of LED technology, including, but not limited to, chip on board (COB) and discrete die.

The trim 150 can be a decorative portion of the light fixture 100 that is visible to users and provides an aesthetic quality to the light fixture 100. The trim 150 can be a separate component that is coupled to another component (e.g., the housing 140) of the light fixture 100. Alternatively, as in this example, the trim 150 can be an integrated extension of the housing 140. Specifically, in this case, the trim 150 is an outward extension of the distal end of the wall 142 of the housing 140. The trim 150 in this case is substantially planar so that the trim 150 abuts against a surface (e.g., a ceiling tile, drywall) when the light fixture 100 is installed.

In some cases, as shown in FIG. 1, there can be a receiving feature 149 disposed between the trim 150 and the distal end of the wall 142 of the housing 140. The receiving feature 149 is configured to receive part (e.g., the flange 129) of the baffle 120 (discussed below) so that the baffle 120 appears continuous with the trim 150. In some cases, the receiving feature 149 can also couple (directly or indirectly) to the trim 150, in addition to merely receiving. The receiving feature 149 can include one or more of any of a number of features. Examples of such features can include, but are not limited to, a recess (as in this case), a slot, a protrusion, a detent, an aperture, and a tab.

In certain example embodiments, the trim 150 or other portion of the housing 140 can include one or more alignment features 158. Such alignment features 158 can be used to indicate the proper orientation of the baffle 120 relative to the housing 140 when the baffle 120 is about to become coupled to the housing 140. Examples of an alignment feature 158 can include, but are not limited to, a hash mark, a protrusion, and a recess.

In this case, the alignment feature 158 is a hash mark disposed on the bottom surface of the trim 150. An alignment feature 158 can be located on any other surface of the trim 150 and/or any other surface of the housing 140. An alignment feature 158 can be visible to a user or hidden from a user when the baffle 120 is disposed in the cavity 141 of the housing 140. The alignment feature 158 can be useful because the coupling features 145 of the housing 140 and the coupling features 125 of the baffle 120 are not visible to a user once the baffle 120 is inserted into the cavity 141 of the housing 140.

An alignment feature 158 can be mechanical (e.g., a sort of coupling of the alignment feature 158 is required in order to proceed in coupling the baffle 120 to the housing 140), visual (e.g., the alignment feature 158 only offers guidance as to how the baffle 120 needs to be oriented relative to the housing 140 to begin coupling baffle 120 to the housing 140), or a combination thereof. In some cases, as in this example, the alignment feature 158 works in conjunction with a corresponding alignment feature (e.g., alignment feature 128) of the baffle 120.

The housing 140 of the light fixture 100 houses one or more components (e.g., the baffle 120, the light sources 160, the power source) of the light fixture 100. Specifically, the housing 140 can include one or more walls 142 that form one or more cavities (e.g., cavity 141), inside of which one or more components of the light fixture 100 can be disposed. For example, cavity 141 formed by certain walls 142 toward the bottom of the housing 140 has disposed therein the baffle 120. This portion of the cavity 141 can have, at least in part, a conical shape.

In certain example embodiments, the housing 140 includes one or more coupling features 145 that detachably couple to one or more complementary coupling features 125 of the baffle 120. The coupling features 145 can be disposed on an inner surface of one or more walls 142 that form the cavity 141. In this case, there are two identically-configured coupling features 145 that are each in the form of an elongated slot that has a spiral shape for approximately ¼ turn (covering approximately 90° when looking into the cavity 141 from the bottom).

At the proximal end of the slot can be a feature (e.g., an opening) to receive the coupling features 125 of the baffle 120 when the baffle 120 is about to be coupled to or decoupled from the housing 140. At the distal end of the slot can be another feature (e.g., a detent) to hold the coupling features 125 of the baffle 120 in place when the baffle 120 is coupled to the housing 140.

When the housing 140 has multiple coupling features 145 disposed on the inner surface of a wall 142, those coupling features 145 can have any of a number of configurations and/or positions relative to each other. For example, one coupling feature 145 can have a configuration (e.g., shape, size) that is the same as, or different than, the configuration of the rest of the coupling features 145. As another example, the multiple coupling features 145 can be positioned equidistantly from each other within the cavity 141. Alternatively, at least one of the coupling features 145 can be offset relative to one or more of the other coupling features 145. In any case, the number, configuration, and position of the coupling features 145 are designed to complement the number, configuration, and position of the coupling features 125 of the baffle 120, as described below.

The baffle 120 is a component of the light fixture 100 that is configured to control effects of light emitted by the light sources 160 of the light fixture 100. The baffle 120 can have one or more walls 122 that can form any of a number of shapes (e.g., pyramid, cube, cylinder). In this case, the baffle 120 has a single wall 122 that forms a conical shape. In certain example embodiments, the shape formed by the wall 122 of the baffle 120 complements, at least in part, the shape of the cavity 141 formed by the walls 142 of the housing 140.

The inner surface of the wall 122 of the baffle 120 forms a cavity 121. Further, the inner surface of the wall 122 of the baffle 120 can have any of a number of optical features 124 that are specifically designed to control the light emitted by the light sources 160 in a certain desired way. Examples of such optical features 124 can include, but are not limited to, a color (e.g., soft white, gray), a type of material (e.g., a reflective material or coating), ribbing, and etchings. The top end of the baffle 120 can have an opening that allows the light sources 160, or at least light emitted by the light sources 160, to be projected into the cavity 121 formed by the walls 122 of the baffle 120.

In certain example embodiments, the baffle 120 includes one or more coupling features 125 disposed on the outer surface of the wall 122 of the baffle 120. Each coupling feature 125 of the baffle 120 is configured to detachably couple to one or more complementary coupling features 145 of the housing 140. In this case, there are two identically-configured coupling features 125 that are each in the form of a horizontally-extending protrusion. More details about the coupling features 125 are provided with respect to FIGS. 3A-3D below.

When the baffle 120 has multiple coupling features 125 disposed on the outer surface of the wall 122, those coupling features 125 can have any of a number of configurations and/or positions relative to each other. For example, one coupling feature 125 can have a configuration (e.g., shape, size) that is the same as, or different than, the configuration of the rest of the coupling features 125. As another example, the multiple coupling features 125 can be positioned equidistantly from each other around the wall 122 of the baffle 120. Alternatively, at least one of the coupling features 125 can be offset relative to one or more of the other coupling features 125. In any case, the number, configuration, and position of the coupling features 125 are designed to complement the number, configuration, and position of the coupling features 145 of the housing 140.

With the configuration of the coupling features 125 (tab extensions) of the baffle 120 and the coupling features 145 (spiral-shaped slots) of the housing 140, the baffle 120 can be coupled to the housing 140 by inserting the coupling features 125 of the baffle 120 into the coupling features 145 of the housing 140, and subsequently rotating the baffle 120 in a clockwise direction (when viewed from below) by about ¼ turn. Similarly, the baffle 120 can be decoupled from the housing 140 by rotating the baffle 120 by about ¼ turn in a counter-clockwise direction, and subsequently lowering the baffle 120 away from the housing 140. In this case, the baffle 120 can be coupled to and decoupled from the housing 140 by hand, without the use of tools (e.g., screwdriver, wrench).

At the distal end of the wall 122 of the baffle 120 can be disposed a flange 129. The flange 129 of the baffle 120 can be visible to users. The flange 129 can be a separate component that is coupled to the distal end of the wall 122 of the baffle 120. Alternatively, as in this example, the flange 129 can be an integrated extension of the wall 122 of the baffle 120. In any case, the flange 129 is configured in such a way as to integrate with the trim 150 while disposed within the receiving feature 149 of the housing 140. For example, the flange 129 in this case is substantially planar so that the flange 129 is disposed within and abuts against the receiving feature 149 of the housing 140 when the baffle 120 is coupled to the housing 140. In this way, the flange 129 of the baffle 120 appears continuous with the trim 150.

In certain example embodiments, the flange 129 or other portion of the baffle 120 can include one or more alignment features 128. Such alignment features 128 can be used to indicate the proper orientation of the baffle 120 relative to the housing 140 when the baffle 120 is about to become coupled to the housing 140. In this case, the alignment feature 128 is a hash mark disposed on the bottom surface of the flange 129. An alignment feature 128 can be located on any other surface of the flange 129 and/or any other surface of the baffle 120. An alignment feature 128 can be visible to a user or hidden from a user when the baffle 120 is disposed in the cavity 141 of the housing 140. As explained above, the alignment feature 128 can be useful because the coupling features 145 of the housing 140 and the coupling features 125 of the baffle 120 are not visible to a user once the baffle 120 is inserted into the cavity 141 of the housing 140.

As with an alignment feature 158 discussed above, an alignment feature 128 can be mechanical (e.g., a sort of coupling of the alignment feature 128 is required in order to proceed in coupling the baffle 120 to the housing 140), visual (e.g., the alignment feature 128 only offers guidance as to how the baffle 120 needs to be oriented relative to the housing 140 to begin coupling baffle 120 to the housing 140), or a combination thereof. In some cases, as in this example, the alignment feature 128 works in conjunction with a corresponding alignment feature (e.g., alignment feature 158) of the trim 150.

Figure 3A:
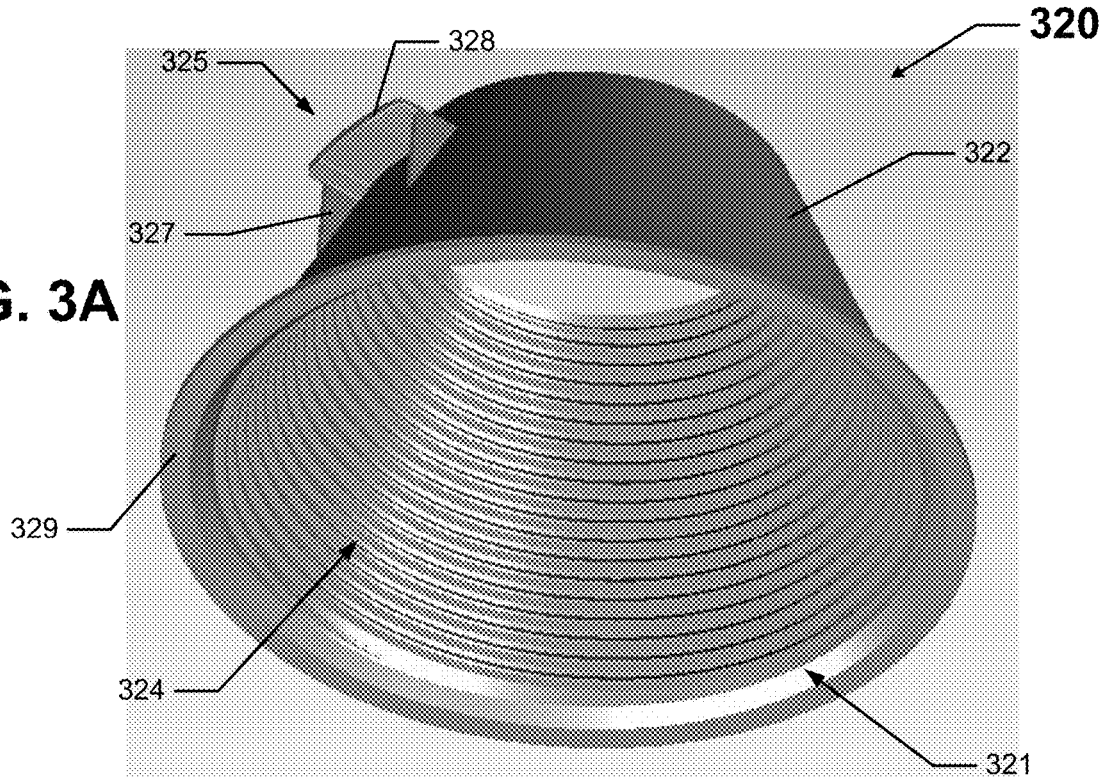
FIGS. 3A-3D show various views of a baffle in accordance with certain example embodiments.
Figure 3B:
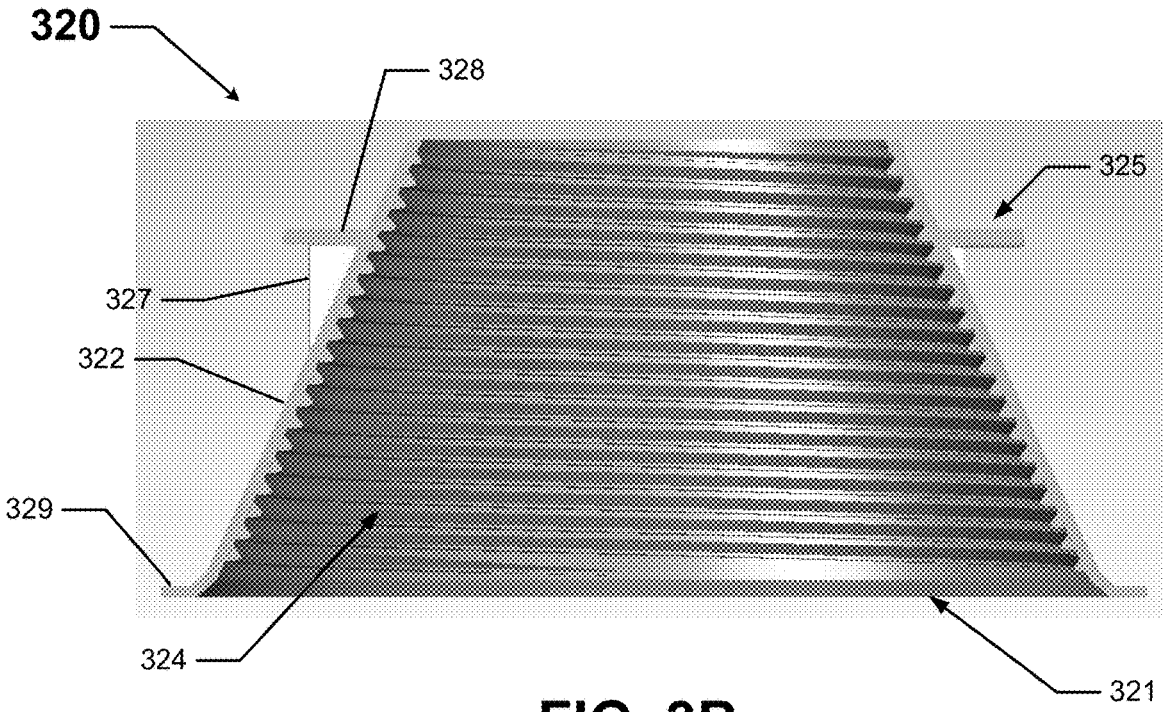
Figure 3C:
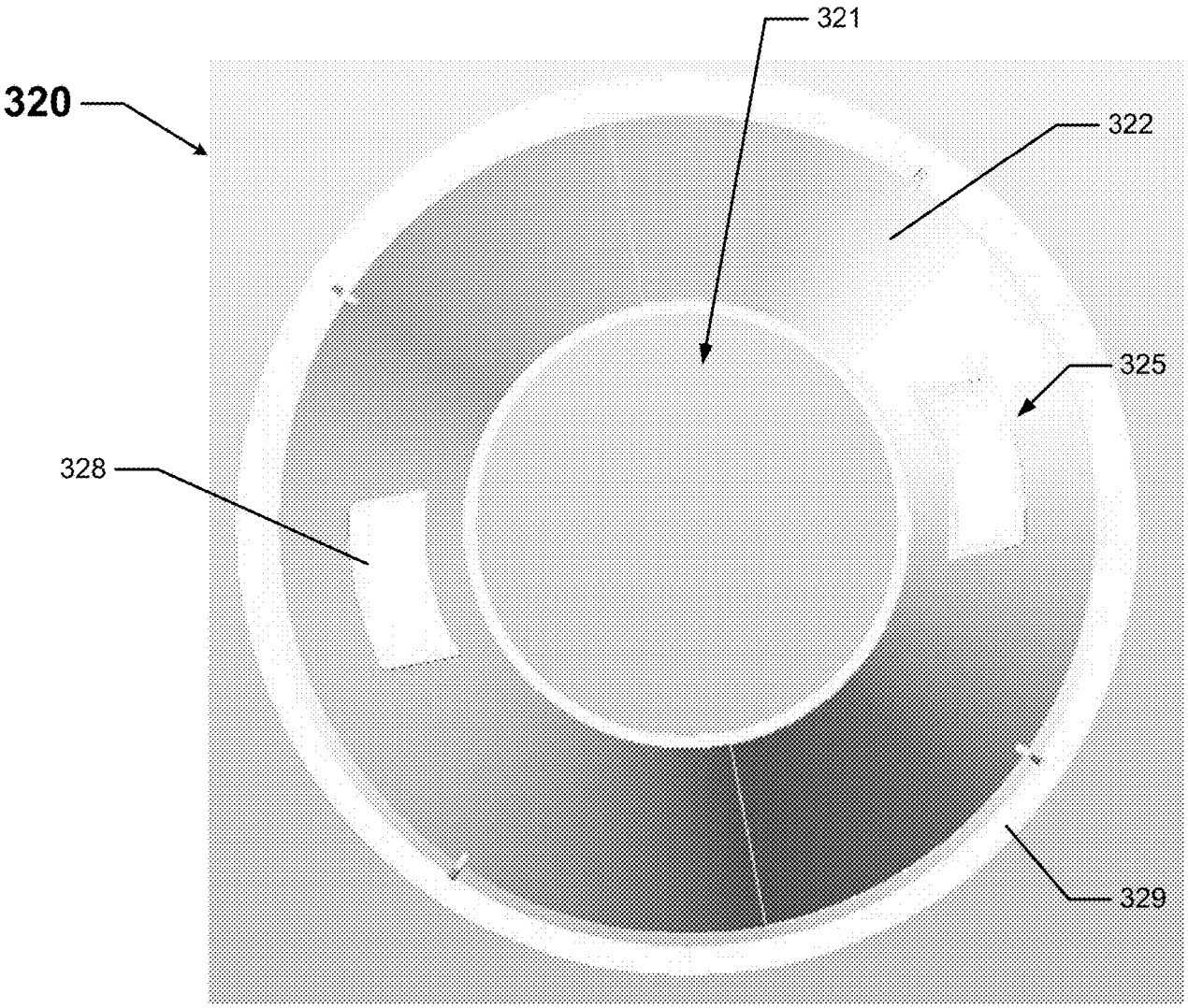
Figure 3D:
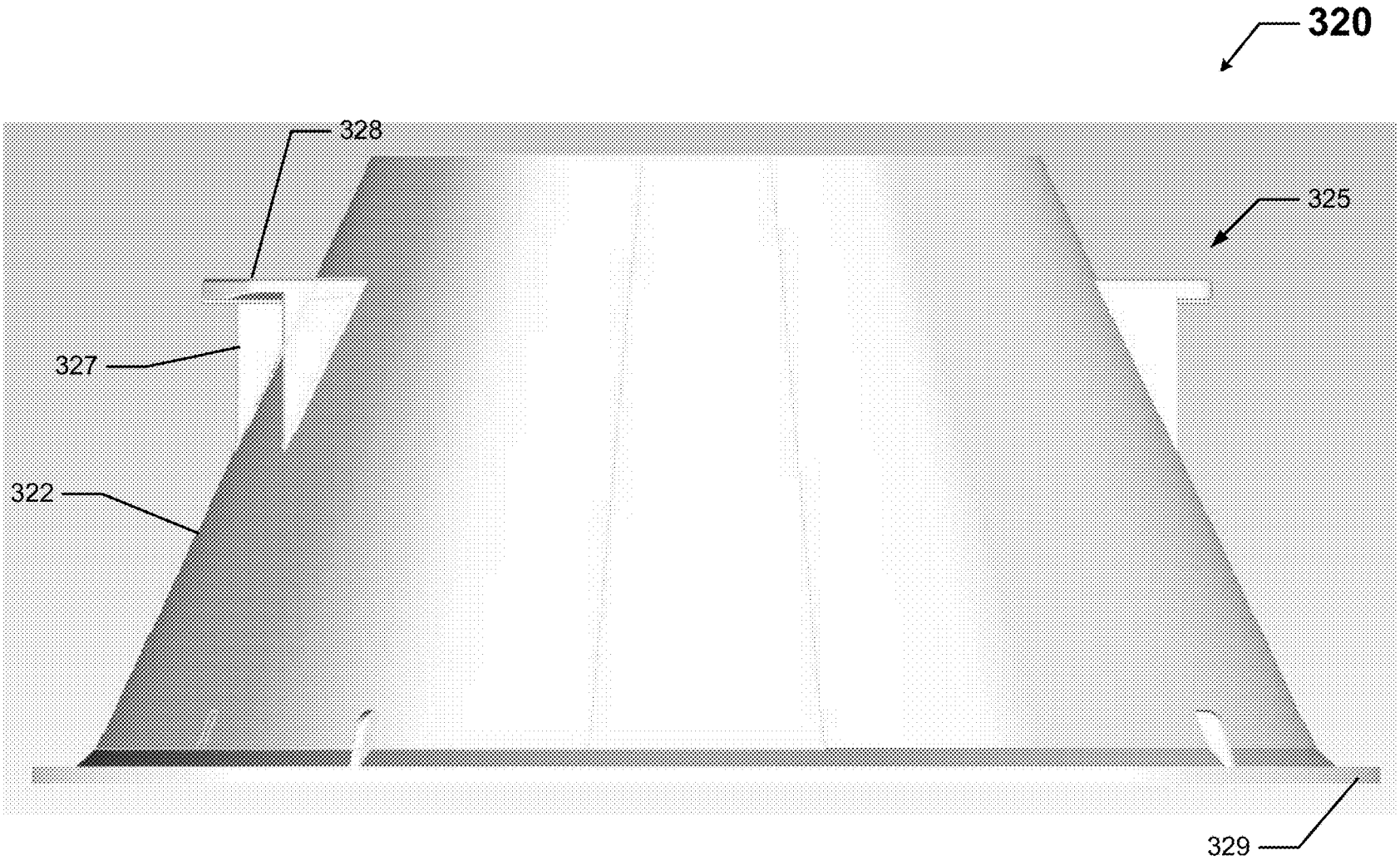

FIGS. 3A-3D show various views of a baffle 320 in accordance with certain example embodiments. Specifically, FIG. 3A shows a bottom-front-side perspective view of the baffle 320. FIG. 3B shows a cross-sectional side view of the baffle 320. FIG. 3C shows a top view of the baffle 320. FIG. 3D shows a side view of the baffle 320.

Referring to FIGS. 1 through 3D, the baffle 320 of FIGS. 3A-3D can be substantially the same as the baffle 120 of FIGS. 1 and 2. For example, the baffle 320 has a single wall 322 that forms a conical shape. The inner surface of the wall 322 of the baffle 320 forms a cavity 321. The top end of the baffle 320 can have an opening that allows the light sources (e.g., light sources 160), or at least light emitted by the light sources, to be projected into the cavity 321 formed by the walls 322 of the baffle 320. Further, the inner surface of the wall 322 of the baffle 320 can have any of a number of optical features 324 that are specifically designed to control the light emitted by the light sources in a certain desired way.

In this example, the baffle 320 includes two coupling features 325 disposed on the outer surface of the wall 322 of the baffle 320. Each coupling feature 325 of the baffle 320 is configured to detachably couple to one or more complementary coupling features (e.g., coupling features 145) of the housing (e.g., housing 140). Each coupling feature 325 includes a horizontally-extending protrusion 328 that is supported by one or more (in this case, two) vertical supports 327. The protrusion 328 extends beyond the vertical supports 327, which allows the protrusion 328 to movably couple to a complementary coupling feature of the housing, an example of which is shown in detail below with respect to FIGS. 4A and 4B.

In this example, the two coupling features 325 are identically configured with respect to each other. Further, the coupling features 325 are positioned equidistantly from each other around the wall 322 of the baffle 320. The number, configuration, and position (in this case, about ¾ up the height of the wall 322) of the coupling features 325 are designed to complement the number, configuration, and position of the coupling features of the housing. The coupling features 325 of the baffle 320 can be integrated with (e.g., extruded), or coupled to (e.g., welded), the wall 322 of the baffle 320.

As with the baffle 120 of FIGS. 1 and 2, at the distal end of the wall 322 of the baffle 320 of FIGS. 3A-3D is disposed a flange 329. The flange 329 is configured in such a way as to integrate with the trim (e.g., trim 150) while disposed within the receiving feature (e.g., receiving feature 149) of the housing (e.g., housing 140). The flange 329 in this case is substantially planar. In this case, the flange 329 (nor any other part of the baffle 320) of FIGS. 3A-3D does not include an alignment feature.

Figure 4A:
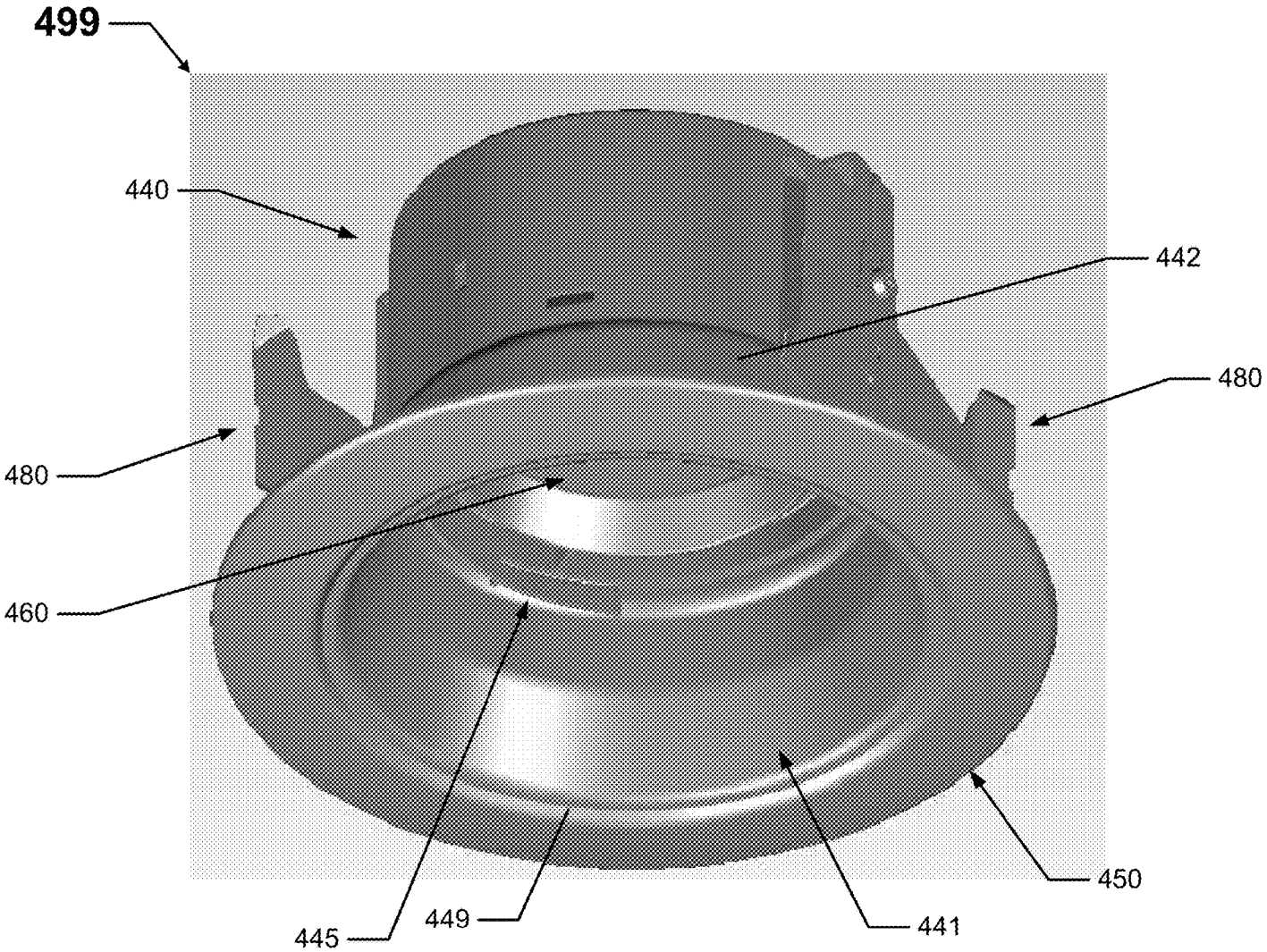
FIGS. 4A and 4B show various views of a subassembly of a light fixture in accordance with certain example embodiments.
Figure 4B:
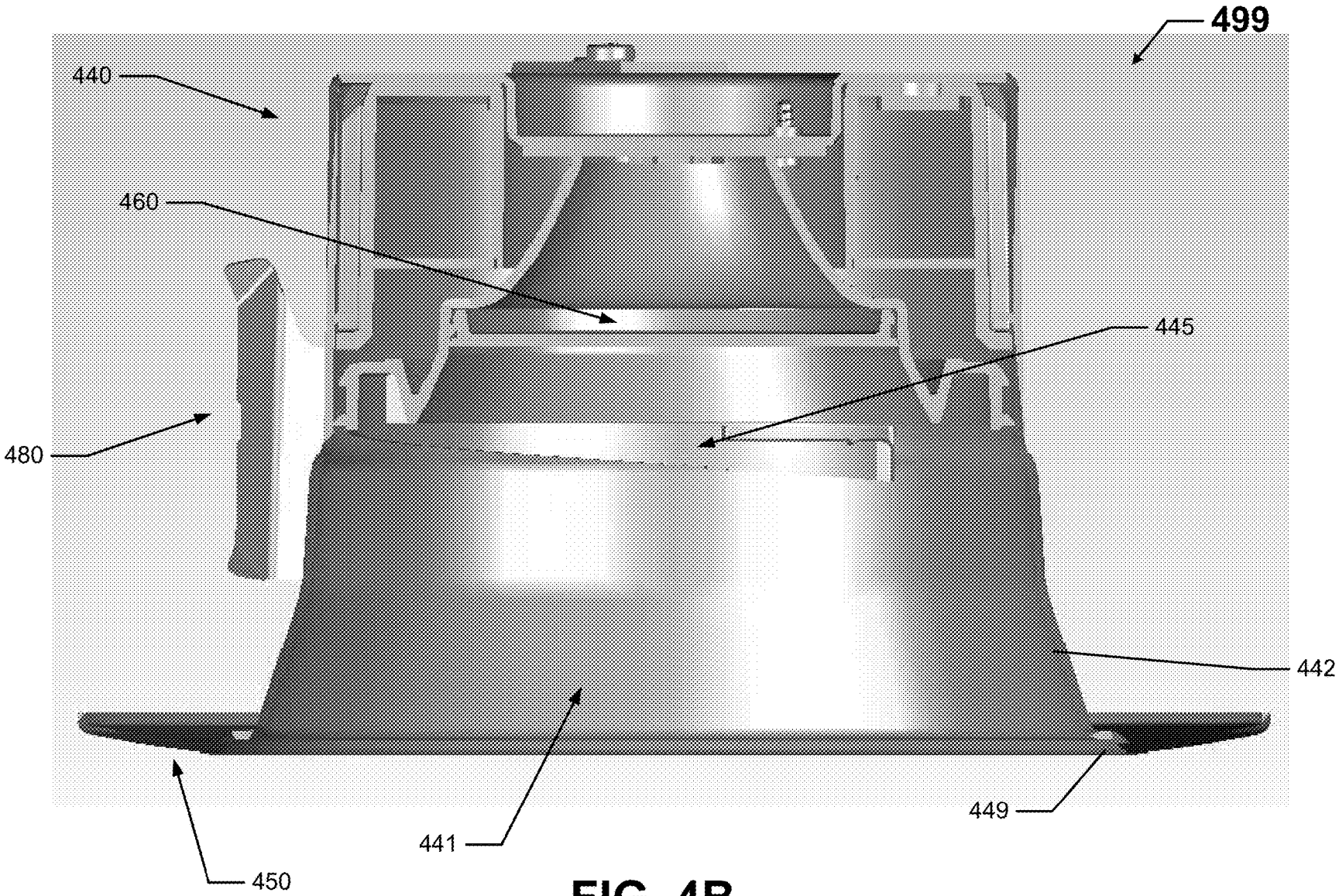

FIGS. 4A and 4B show various views of a subassembly 499 of a light fixture in accordance with certain example embodiments. Specifically, FIG. 4A shows a bottom-front-side perspective view of the subassembly 499. FIG. 4B shows a cross-sectional side view of the subassembly 499. The subassembly 499 includes a housing 440 and a pair of mounting features 480 coupled to the housing 440.

The various components of the subassembly 499 of FIGS. 4A and 4B can be substantially the same as the corresponding components of the light fixture 100 of FIGS. 1 and 2. For example, the pair of mounting features 480 are identically-configured friction blades that are disposed on (coupled to) the outer surface of a side wall 442 of the housing 440 equidistantly with respect to each other.

The trim 450 in this case is an outward extension of the distal end of the wall 442 of the housing 440. The trim 450 is substantially planar so that the trim 450 abuts against a surface (e.g., a ceiling tile, drywall) when the light fixture is installed. The subassembly 499 also includes a receiving feature 449 disposed between the trim 450 and the distal end of the wall 442 of the housing 440. The receiving feature 449 is configured to receive part (e.g., the flange 329) of the baffle (e.g., baffle 320) so that the baffle appears continuous with the trim 450. The receiving feature 449 in this example includes a recess that is disposed all the way around the bottom end of the housing 440.

The housing 440 has at least one wall 442 that forms a cavity 441 inside of which a baffle (e.g., baffle 320) can be disposed. The upper portion of the cavity 441 has a cylindrical shape, and the bottom portion of the cavity 441 has a conical shape. There are two coupling features 445 that detachably couple to one or more complementary coupling features (e.g., coupling features 325) of a baffle (e.g., baffle 320). The coupling features 445 in this case are disposed on the inner surface of the upper side wall 442 that forms part of the cavity 441.

The two identically-configured coupling features 445 are each in the form of an elongated slot that has a spiral shape for approximately ⅓ turn (covering approximately 90° when looking into the cavity 441 from the bottom). The two coupling features 445 are positioned equidistantly from each other within the cavity 441. The number, configuration, and position of the coupling features 445 are designed to complement the number, configuration, and position of the coupling features of the baffle.

Example embodiments allow a baffle to be removably coupled to a housing of a light fixture. In some cases, an example baffle can be installed and removed without the use of tools, allowing a user to easily install and/or remove a baffle without removing the light fixture from its installed position and without disassembling other portions or components of the light fixture. In this way, baffles can easily be interchanged to produce a desired lighting effect (e.g., different shade, different focus, different color) of light emitted by the light sources of the light fixture.

Accordingly, many modifications and other embodiments set forth herein will come to mind to one skilled in the art to which example embodiments pertain having the benefit of the teachings presented in the foregoing descriptions and the associated drawings. Therefore, it is to be understood that example embodiments are not to be limited to the specific embodiments disclosed and that modifications and other embodiments are intended to be included within the scope of this application. Although specific terms are employed herein, they are used in a generic and descriptive sense only and not for purposes of limitation.

What is claimed is:

1. A light fixture comprising:

a housing comprising at least one housing wall having an inner surface that forms a cavity, wherein the inner surface of the at least one housing wall has at least one baffle coupling feature disposed thereon; and a baffle removably coupled to the housing, wherein the baffle comprises at least one baffle wall having an outer surface, wherein the outer surface of the at least one baffle wall has at least one housing coupling feature disposed thereon, wherein the at least one baffle coupling feature and the at least one housing coupling feature become coupled to each other by rotating the baffle in a first direction relative to the housing, and wherein the at least one baffle coupling feature and the at least one housing coupling feature become decoupled from each other by rotating the baffle in a second direction opposite the first direction relative to the housing.

2. The light fixture of claim 1, wherein the inner surface of the at least one housing wall, when viewed from below, is conical, and wherein the outer surface of the at least one baffle wall, when viewed from above, is conical.

3. The light fixture of claim 1, wherein the at least one housing coupling feature comprises at least two tabs that extend from the outer surface of the at least one baffle wall, and wherein the at least one baffle coupling feature comprises at least two slots disposed in the inner surface of the at least one enclosure wall.

4. The light fixture of claim 1, wherein the at least one housing coupling feature comprises a first housing coupling feature and a second housing coupling feature, wherein the first housing coupling feature and the second housing coupling feature are offset relative to each other around the baffle.

5. The light fixture of claim 1, wherein the first at least one baffle coupling feature has a spiral shape.

6. The light fixture of claim 1, wherein the baffle is rotated less than a half turn relative to the housing to couple the at least one baffle coupling feature and the at least one housing coupling feature to each other.

7. The light fixture of claim 1, wherein the first at least one baffle coupling feature comprises at least one slot, wherein the at least one slot comprises an opening and a detent disposed opposite the opening.

8. The light fixture of claim 1, wherein a distal edge of the baffle is substantially flush with a trim that extends from a distal end of the at least one housing wall when the baffle is coupled to the housing.

9. The light fixture of claim 8, wherein the distal end of the at least one housing wall comprises a recess for receiving the baffle when the baffle is coupled to the housing.

10. A baffle for a light fixture, the baffle comprising:

at least one wall having an inner baffle surface and an outer baffle surface, wherein the inner baffle surface is configured to control effects of light emitted by the light fixture; and at least one housing coupling feature disposed on the outer baffle surface of the at least one wall, wherein the at least one housing coupling feature is configured to detachably couple to at least one baffle coupling feature disposed on an inner housing surface of a housing of the light fixture, wherein the at least one housing coupling feature is configured to become coupled to the at least one baffle coupling feature by rotating the baffle in a first direction relative to the housing, wherein the at least one housing coupling feature is further configured to become decoupled from the at least one baffle coupling feature by rotating the baffle in a second direction that opposes the first direction relative to the housing.

11. The baffle of claim 10, wherein the at least one housing coupling feature comprises at least two tabs that extend from the outer surface of the at least one wall.

12. The baffle of claim 11, wherein the first tab and the second tab are not spaced equidistantly from each other around the outer baffle surface.

13. The baffle of claim 11, wherein the first tab and the second tab are spaced equidistantly from each other around the outer baffle surface.

14. The baffle of claim 10, further comprising:

an alignment feature disposed on the at least one wall, wherein the alignment feature is configured to properly align the at least one housing coupling feature relative to the at least one baffle coupling feature when the at least one housing coupling feature is about to couple to the at least one baffle coupling feature.

15. The baffle of claim 10, wherein the at least one housing coupling feature comprises a structural support between a proximal end of the at least one housing coupling feature and the outer surface of the at least one wall.

16. The baffle of claim 10, wherein the at least one housing coupling feature comprises threads disposed in the outer surface of the at least one wall.

17. The baffle of claim 10, wherein the at least one wall has a conical shape.

18. A housing for a light fixture, the housing comprising:

at least one wall having an inner surface, wherein the inner surface is configured to receive at least a portion of a baffle of the light fixture, wherein the inner surface of the at least one wall has disposed thereon at least one baffle coupling feature, wherein the at least one baffle coupling feature is configured to detachably couple to at least one housing coupling feature disposed on an outer surface of the baffle of the light fixture, wherein the at least one baffle coupling feature is configured to become coupled to the at least one housing coupling feature when the baffle is rotated in a first direction relative to the at least one wall, wherein the at least one baffle coupling feature is further configured to become decoupled from the at least one housing coupling feature by rotating the baffle in a second direction that opposes the first direction relative to the at least one wall.

19. The housing of claim 18, wherein the at least one baffle coupling feature comprises at least one slot, wherein the at least one slot comprises an opening and a detent disposed opposite the opening.

20. The housing of claim 19, wherein the at least one slot is up to ¼ of a circumference of the inner surface of the at least one wall.

* * * * *